US009163876B2

(12) United States Patent
Chiwata et al.

(10) Patent No.: US 9,163,876 B2
(45) Date of Patent: Oct. 20, 2015

(54) DRYING DEVICE AND IMAGE FORMING APPARATUS

(71) Applicant: FUJIFILM CORPORATION, Tokyo (JP)

(72) Inventors: Yuhei Chiwata, Kanagawa (JP); Masahiro Ohba, Kanagawa (JP); Masataka Hasegawa, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 13/727,156

(22) Filed: Dec. 26, 2012

(65) Prior Publication Data

US 2013/0194367 A1 Aug. 1, 2013

(30) Foreign Application Priority Data

Jan. 31, 2012 (JP) ..... 2012-019251

(51) Int. Cl.

| | |
|---|---|
| ***F26B 17/28*** | (2006.01) |
| ***F26B 21/00*** | (2006.01) |
| ***B41F 23/04*** | (2006.01) |
| ***B41J 11/00*** | (2006.01) |

(52) U.S. Cl.

CPC ..... *F26B 21/004* (2013.01); *B41F 23/0443* (2013.01); *B41F 23/0466* (2013.01); *B41J 11/002* (2013.01); *B41J 11/0015* (2013.01)

(58) Field of Classification Search

CPC ..... B41J 11/002

See application file for complete search history.

(56) References Cited

U.S. PATENT DOCUMENTS

| | | | |
|---|---|---|---|
| 6,293,196 | B1 | 9/2001 | DeMoore et al. |
| 6,463,674 | B1 | 10/2002 | Meyers et al. |
| 2005/0217523 | A1 | 10/2005 | Hachmann et al. |
| 2011/0261102 | A1 | 10/2011 | Kurasawa et al. |

FOREIGN PATENT DOCUMENTS

| | | | |
|---|---|---|---|
| JP | H08-11299 | A | 1/1996 |
| JP | H08-224871 | A | 9/1996 |
| JP | 2001-334647 | A | 12/2001 |
| JP | 2003-326682 | A | 11/2003 |
| JP | 2003-335447 | A | 11/2003 |
| JP | 2004-174887 | A | 6/2004 |
| JP | 2004-275998 | A | 10/2004 |
| JP | 2005-289059 | A | 10/2005 |
| JP | 2009-045861 | A | 3/2009 |
| JP | 2010-125819 | A | 6/2010 |
| JP | 2011-224932 | A | 11/2011 |
| WO | 2010/137299 | A1 | 12/2010 |

OTHER PUBLICATIONS

Machine translation of JP 08-011299 A. (JP 08-011299 A was published on Jan. 16, 1996.).*

(Continued)

*Primary Examiner* — Justin Seo

(74) *Attorney, Agent, or Firm* — Studebaker & Brackett PC

(57) ABSTRACT

There is provided a drying device including: an airflow path extending in a direction intersecting with a conveyance path of a recording medium; an external air intake section that introduces external air into the airflow path; and a heating and blowing section provided to the airflow path that heats external air introduced into the airflow path and blows drying air onto a front face of the recording medium being conveyed on the conveyance path.

12 Claims, 11 Drawing Sheets

(56) References Cited

OTHER PUBLICATIONS

The extended European Search Report dated May 8, 2013, which corresponds to EP Application No. 12199460.2-1701 and is related to U.S. Appl. No. 13/727,156.

An Office Action; "Notice of Reasons for Rejection," issued by the Japanese Patent Office on Nov. 19, 2013, which corresponds to Japanese Patent Application No. 2012-019251 and is related to U.S. Appl. No. 13/727,156; with English language translation.

* cited by examiner

DRYING DEVICE AND IMAGE FORMING APPARATUS

CROSS-REFERENCE TO RELATED APPLICATION

This application is based on and claims priority under 35 USC 119 from Japanese Patent Application No. 2012-019251 filed on Jan. 31, 2012, the disclosure of which is incorporated by reference herein.

BACKGROUND

1. Technical Field

The present invention relates to a drying device and to an image forming apparatus.

2. Related Art

In image forming apparatuses, a known liquid droplet jetting recording type image forming apparatus includes liquid droplet jetting heads with multiple nozzles arranged in a row. Paper (a recording medium) is conveyed with respect to the liquid droplet jetting heads to form an image (including text) on the paper by jetting liquid droplets of for example ink from the nozzles towards the paper.

Processing performed after image forming in such liquid droplet jetting recording type image forming apparatuses reduces paper distortion (curling and cockling) caused by moisture in the liquid droplets by drying the paper onto which the liquid droplets have been jetted with a drying device.

Japanese Patent Application Laid-Open (JP-A) No. 2011-224932 discloses a configuration wherein external air is introduced into a drying device from the outside of an image forming apparatus, and the external air is blown as drying air onto a recording medium by a fan provided to the side of the recording medium that is being conveyed along a conveyance path.

JP-A No. 2009-45861 and JP-A No. 2010-125819 disclose a configuration wherein air inside an image forming apparatus is introduced into a drying device, and this air is blown as drying air onto the front face of a recording medium that is being conveyed on a conveyance path.

However, in the configuration of JP-A No. 2011-224932, the rate at which drying air is blown onto the recording medium is not uniform across the width direction of the recording medium since the drying air is blown from the side of the recording medium.

In the configurations of JP-A No. 2009-45861 and JP-A No. 2010-125819, the moisture content of the drying air increases since moist air inside the image forming apparatus is blown onto the recording medium as drying air.

SUMMARY

In consideration of the above circumstances, an object of the present invention is to provide a drying device and an image forming apparatus that can blow drying air onto a recording medium at a uniform rate across the width direction of the recording medium, whilst suppressing an increase in the moisture content of the drying air.

A first aspect of the present invention provides a drying device including:

an airflow path extending in a direction intersecting with a conveyance path of a recording medium;

an external air intake section that introduces external air into the airflow path; and a heating and blowing section provided to the airflow path that heats external air introduced into the airflow path and blows drying air onto a front face of the recording medium being conveyed on the conveyance path.

According to the above configuration, external air introduced into the airflow path by the external air intake section is blown onto the front face of the recording medium as drying air by the heating and blowing section provided to the airflow path. The airflow rate can be made uniform across the width direction of the recording medium by blowing the drying air onto the front face of the recording medium.

Further, an increase in the moisture content of the drying air can be suppressed due to using external air for the drying air.

A second aspect of the present invention provides the drying device of the first aspect, wherein a circulation opening is formed along the length direction of the airflow path.

According to the above configuration, the energy efficiency of the heating and blowing section is improved since the drying air, which is blown out from the heating and blowing section, can be taken back into the airflow path through the circulation opening as recirculated air and recirculated.

A third aspect of the present invention provides the drying device of the second aspect, wherein the circulation opening comprises a partitioning plate that partitions recirculated air that is drying air recirculated to the circulation opening and external air that has been introduced into the airflow path.

According to the above configuration, the mixture ratio of fresh air and recirculated air can be made uniform along the length direction of the airflow path since circulated drying air in the airflow path, namely recirculated air, and external air introduced by the external air intake section flowing in the airflow path, namely fresh air, do not interfere with each other due to the partitioning plate.

A fourth aspect of the present invention provides the drying device of the third aspect, wherein:

the partitioning plate comprises a horizontal side extending horizontally towards the inside of the airflow path and a vertical side bending around from a leading edge of the horizontal side towards the heating and blowing section; and both end portions of the partitioning plate are closed off with sealing plates.

According to the above configuration, recirculated air taken into the airflow path through the circulation opening hits the hood (vertical side) facing the circulation opening and changes direction towards the heating and blowing section side. Fresh air introduced into the airflow path from the external air intake section hits the sealing plates and is not introduced into the hood. Since the recirculated air circulating in the airflow path and the fresh air introduced by the external air intake section start to be mixed together in the vicinity of air fans, the mixture ratio of fresh air and recirculated air can be made more uniform across the length direction of the airflow path than if the sealing plates were not provided.

A fifth aspect of the present invention provides the drying device of any one of the second to fourth aspects, wherein the circulation opening is formed to the conveyance path upstream side of the airflow path.

Since drying of the recording medium takes place to the conveyance path downstream side of the airflow path, moisture content increases by the amount of moisture that has been evaporated from the recording medium.

In the configuration of the fifth aspect, the circulation opening is formed to the conveyance path upstream side of the airflow path. Therefore, drying air (recirculated air) taken in to the airflow path through the circulation opening accordingly has a lower moisture content than in cases in which the circulation opening is formed to the conveyance path downstream side of the airflow path.

A sixth aspect of the present invention provides the drying device of any one of the second to fifth aspects, wherein:

the heating and blowing section comprises a plurality of axial fans provided along the airflow path length direction that take in external air that has been introduced into the airflow path and recirculated air that has been recirculated to the circulation opening and blows out the combined air; and a heater that heats air blown from each of the axial fans to produce the drying air; and the circulation opening is formed with a size such that recirculated air is taken in uniformly by each of the axial fans.

According to the above configuration, the moisture content of the drying air blown onto the recording medium from the heating and blowing section can be made more uniform across the width direction.

A seventh aspect of the present invention provides the drying device of any one of the first to sixth aspects, wherein the external air intake section is provided at both sides of the airflow path.

According to the above configuration, the amount of external air contained in the drying air blown from the heating and blowing section onto the recording medium can be made more uniform across the width direction than in cases where the external air intake section is provided at only one side of the airflow path, since the external air introduced by the external air intake section circulates and becomes uniform inside the airflow path.

An eighth aspect of the present invention provides the drying device of any one of the first to seventh aspects, wherein the heating and blowing section comprises a constricted opening that blows drying air onto the front face of the recording medium.

According to the above configuration, providing the constricted opening increases the airflow rate of drying air and raises the water vapor removal efficiency.

A ninth aspect of the present invention provides the drying device of any one of the first to eighth aspects, wherein a gripping member that grips the recording medium and conveys the recording medium on the conveyance path is attached to a moving member that travels in a circuit around the outside of the airflow path and the heating and blowing section.

According to the above configuration, external air can be introduced avoiding the moving member since the airflow path is disposed so as to protrude out in the width direction from between the circulating moving member.

A tenth aspect of the present invention provides an image forming apparatus including:

the drying device of any one of the first to ninth aspects; and a liquid droplet jetting head that is provided to the conveyance path upstream side of the drying device and that jets liquid droplets onto the recording medium and renders an image.

According to the above configuration, the front face of the recording medium jetted with liquid droplets from the liquid droplet jetting head can be dried uniformly by the drying device across the width direction.

An eleventh aspect of the present invention provides the image forming apparatus of the tenth aspect, wherein:

the external air intake section comprises a fan; and the image forming apparatus further comprises a controller that controls the airflow rate of the fan according to the liquid droplet amount jetted onto the recording medium.

According to the above configuration, the controller controls for example to decrease the airflow rate when the jetted liquid droplet amount is less than a given standard value, and to increase the airflow rate when the jetted liquid droplet amount is more than a given standard value. The recording medium can accordingly be dried reliably, and the energy efficiency of the fan(s) can also be raised.

BRIEF DESCRIPTION OF THE DRAWINGS

Exemplary embodiments of the present invention will be described in detail based on the following figures, wherein.

DETAILED DESCRIPTION

Explanation follows regarding an exemplary embodiment of the present invention, with reference to the drawings.

Apparatus Configuration

Figure 1:
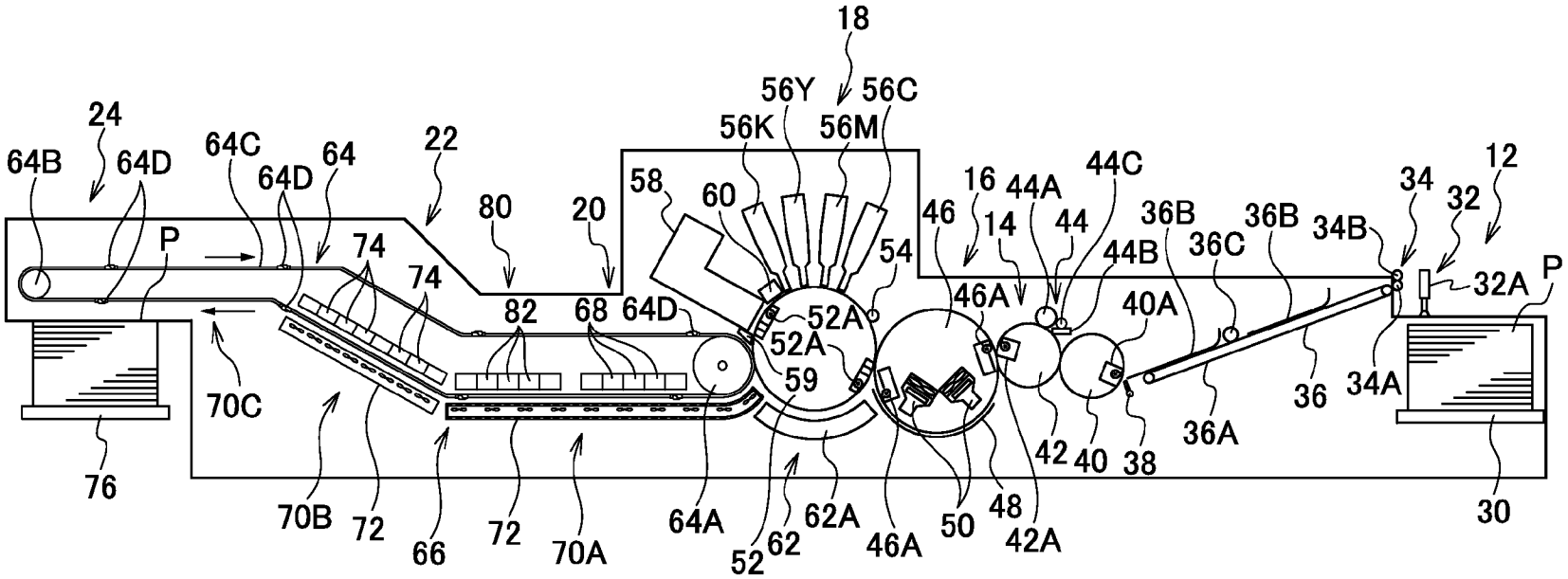
FIG. 1 is a drawing of an overall configuration of an exemplary embodiment of an inkjet recording apparatus serving as an image forming apparatus according to the present invention.

FIG. 1 is a drawing of an overall configuration of an exemplary embodiment of an inkjet recording apparatus serving as an image forming apparatus of the present invention.

An inkjet recording apparatus 10 is an inkjet recording apparatus for recording an image on sheets of paper P (recording medium) by an inkjet method using water-based UV inks (inks that use an aqueous medium and are cured with ultraviolet (UV) light). The inkjet recording apparatus 10 is configured so as to principally include: a paper feed section 12 for feeding the paper P; a process liquid application section 14 for applying a specific process liquid onto the front face (image recording face) of the paper P fed in from the paper feed section 12; a process liquid drying section 16 for drying the paper P applied with the process liquid by the process liquid application section 14; an image recording section 18 for recording an image with an inkjet method using water-based UV inks on the front face of the paper P that has been subjected to drying by the process liquid drying section 16; an ink drying section 20 for drying the paper P recorded with an image by the image recording section 18; a water application section 80 for applying water to the paper P that has been dried by the ink drying section 20; a UV irradiation section 22 for performing UV irradiation (fixing processing) to the paper P applied with water by the water application section 80 so as to fix images onto the paper P; and a paper discharge section 24 for discharging the paper P that has been irradiated with UV by the UV irradiation section 22.

Paper Feed Section

The paper feed section 12 feeds paper P stacked on a paper feed plate 30 to the process liquid application section 14 one sheet at a time. The paper feed section 12, serving as an example of a paper feed section, is configured so as to principally include: the paper feed plate 30; a sucker device 32; a pair of paper feed rollers 34; a feeder board 36; a front stop 38; and a paper feed drum 40.

The paper P is placed on the paper feed plate 30 in a bundles of multiple stacked sheets. The paper feed plate 30 is equipped with a paper feed plate raising and lowering device, not shown in the drawings, that is capable of raising and lowering the paper feed plate 30. The paper feed plate raising and lowering device is coordinated with increases and decreases in the paper P stacked on the paper feed plate 30, with drive of the paper feed plate raising and lowering device controlled to raise and lower the paper feed plate 30 such that the paper P positioned uppermost in the batch is at a constant height.

The paper P serving as a recording medium is not particularly limited, and general purpose printing paper (paper principally formed from cellulose, such as what is referred to as premium grade paper, coated paper, or art paper) used in offset printing may be employed.

The sucker device 32 picks up the paper P stacked on the paper feed plate 30 one sheet at a time in sequence from the top, and feeds the paper P to the pair of paper feed rollers 34. The sucker device 32 is equipped with suction feet 32A provided so as to be capable of raising, lowering and swinging. The top face of the paper P is suction-attached and retained by the suction feet 32A, such that the paper P is conveyed from the paper feed plate 30 to the pair of paper feed rollers 34. Specifically the suction feet 32A suction-attach and retain the top face of the leading edge side of the uppermost paper P, pick up the paper P, and insert the leading edge of the picked-up paper P between a pair of rollers 34A, 34B that configure the pair of paper feed rollers 34.

The pair of paper feed rollers 34 are configured by a pair of top and bottom rollers 34A, 34B that are in press contact with each other. A first out of the pair of top and bottom rollers 34A, 34B is a drive roller (roller 34A) and the other is a following roller (roller 34B). The drive roller (roller 34A) is rotationally driven by a motor, not shown in the drawings. The motor is driven in coordination with feeding the paper P. When the paper P is fed from the sucker device 32, the motor rotates the drive roller (roller 34A) at a coordinated timing. The paper P inserted between the pair of top and bottom rollers 34A, 34B is nipped by the rollers 34A, 34B and fed in the rotation direction of the rollers 34A, 34B (the direction in which the feeder board 36 is disposed).

The feeder board 36 is formed corresponding to the paper width, and receives the paper P fed out by the pair of paper feed rollers 34 and guides the paper P to the front stops 38. The feeder board 36 is disposed so as to slope downwards, and the paper P placed on the conveyance face of the feeder board 36 is then guided by sliding along the conveyance face to the front stops 38.

Plural tape feeders 36A for conveying the paper P are disposed to the feeder board 36 at intervals in the width direction. The tape feeders 36A are formed in an endless shape, and are driven so as to rotate by a motor, not shown in the drawings. The paper P placed on the conveyance face of the feeder board 36 is fed by the tape feeders 36A and conveyed on the feeder board 36.

Retainers 36B and a roller 36C are also disposed on the feeder board 36. Plural of the retainers 36B are disposed front-to-rear in lines along the paper P conveyance face (two in the present example). The retainers 36B are configured by plate springs with a width corresponding to the paper width, and are disposed in press contact with the conveyance face. Unevenness in the paper P conveyed on the feeder board 36 by the tape feeders 36A is corrected by passing under the retainers 36B.

The roller 36C is provided between the front and rear retainers 36B. The roller 36C is disposed in press contact with the conveyance face of the paper P. The paper P being conveyed between the front and rear retainers 36B is conveyed with the top face of the paper P pressed down by the roller 36C.

The front stop 38 corrects the orientation of the paper P. The front stop 38 is formed in a plate shape and is disposed orthogonally to the paper P conveyance direction. The front stop 38 is driven by a motor, not shown in the drawings, and is provided so as to be capable of swinging. The orientation of the paper P being conveyed on the feeder board 36 is corrected by the leading edge of the paper P contacting the front stop 38 (called skew prevention). The front stop 38 swings in coordination with paper feed to the paper feed drum 40, and the orientation-corrected paper P is passed over to the paper feed drum 40.

The paper feed drum 40 receives the paper P fed from the feeder board 36 through the front stops 38 and conveys the paper P towards the process liquid application section 14. The paper feed drum 40 is formed in a circular cylindrical shape and is rotationally driven by a motor, not shown in the drawings. Grippers 40A are also provided on the outer peripheral face of the paper feed drum 40 for gripping the leading edge of the paper P. The paper feed drum 40 thereby conveys the paper P towards the process liquid application section 14 by rotating with the leading edge portions of the paper P gripped by the grippers 40A and the paper P wrapped onto the peripheral face of the paper feed drum 40.

Process Liquid Application Section

The process liquid application section 14 applies a specific process liquid to the front face (image recording face) of the paper P. The process liquid application section 14 is configured so as to principally include: a process liquid application drum 42 for conveying the paper P, and a process liquid application unit 44 for applying a specific process liquid to the printing face of the paper P being conveyed by the process liquid application drum 42.

The process liquid application drum 42 receives the paper P from the paper feed drum 40 of the paper feed section 12 and conveys the paper P towards the process liquid drying section 16. The process liquid application drum 42 is formed in a circular cylindrical shape and is rotationally driven by a motor, not shown in the drawings. Grippers 42A are also provided on the outer peripheral face of the process liquid application drum 42 for gripping the leading edge of the paper P. The process liquid application drum 42 conveys the paper P towards the process liquid drying section 16 by rotating with the leading edge of the paper P gripped by the grippers 42A and with the paper P wrapped around the peripheral face of the process liquid application drum 42 (one sheet of the paper P is conveyed with one rotation of the process liquid application drum 42). The rotation of the process liquid application drum 42 and the paper feed drum 40 are controlled such that timings for passing over and receiving the paper P are coordinated with each other. Namely, the process liquid application drum 42 and the paper feed drum 40 are driven such that they have the same peripheral speed and are driven such that the positions of the grippers are coordinated with each other.

The process liquid application unit 44 uses a roller to coat the process liquid on the front face of the paper P being conveyed by the process liquid application drum 42. The process liquid application unit 44 is configured so as to principally include: a coating roller 44A for coating process liquid to the paper P; a process liquid tank 44B in which process liquid is stored; and a pickup roller 44C for picking up process liquid stored in the process liquid tank 44B and feeding it to the coating roller 44A.

Note than in the present example, configuration is made wherein the process liquid is coated by a roller, however, the method for applying the process liquid is not limited thereto. Configuration may also be adopted wherein the process liquid is applied employing inkjet heads, or applied as a spray.

Process Liquid Drying Section

The process liquid drying section 16 dries the paper P whose front face has been applied with process liquid. The process liquid drying section 16 is configured so as to principally include: a process liquid drying drum 46 for conveying the paper P; a paper conveyance guide 48; and process liquid drying units 50 for drying the process liquid by blowing drying air onto the printing face of the paper P being conveyed by the process liquid drying drum 46.

The process liquid drying drum 46 receives the paper P from the process liquid application drum 42 of the process liquid application section 14 and conveys the paper P towards the image recording section 18. The process liquid drying drum 46 is configured with a circular cylindrical shaped frame body and is rotationally driven by a motor, not shown in the drawings. Grippers 46A are provided on the outer peripheral face of the process liquid drying drum 46 for gripping the leading edge of the paper P. The process liquid drying drum 46 conveys the paper P towards the image recording section 18 by rotating with the leading edge of the paper P gripped by the grippers 46A. Note that the process liquid drying drum 46 of the present example is provided with the grippers 46A at two locations on the outer peripheral face, in a configuration capable of conveying two sheets of the paper P with a single rotation. Rotation of the process liquid drying drum 46 and the process liquid application drum 42 is controlled such that the timings for receiving and passing over the paper P are coordinated with each other. Namely, the process liquid drying drum 46 and the process liquid application drum 42 are driven such that they have the same peripheral speed and are driven such that the positions of the grippers are coordinated with each other.

The paper conveyance guide 48 is disposed along the paper P conveyance path to the side of the process liquid drying drum 46, and guides conveyance of the paper P.

The process liquid drying units 50 are disposed inside the process liquid drying drum 46, and dry by blowing drying air onto the front face of the paper P being conveyed by the process liquid drying drum 46. The solvent component in the process liquid is accordingly driven off, forming an ink aggregation layer on the front face of the paper P. In the present example, two of the process liquid drying units 50 are provided inside the process liquid drying drum 46, and are configured to blow drying air towards the front face of the paper P that is being conveyed by the process liquid drying drum 46.

Image Recording Section

The image recording section 18 renders a color image on the printing face of the paper P by dotting liquid droplets of ink (water-based UV ink) of colors C, M, Y, K onto the printing face of the paper P. The image recording section 18 is configured so as to principally include: an image recording drum 52 for conveying the paper P; a paper press roller 54 for pressing the paper P conveyed by the image recording drum 52 so as to place the paper P in close contact with the peripheral face of the image recording drum 52; inkjet heads 56C, 56M, 56Y, 56K serving as examples of liquid droplet jetting heads for jetting ink droplets of each color C, M, Y, K onto the paper P; an inline sensor 58 for reading an image recorded on the paper P; a mist filter 60 for trapping ink mist; and a drum cooling unit 62.

The image recording drum 52 receives the paper P from the process liquid drying drum 46 of the process liquid drying section 16 and conveys the paper P towards the ink drying section 20. The image recording drum 52 is formed in a circular cylindrical shape and is rotationally driven by a motor, not shown in the drawings. Grippers 52A are provided on the outer peripheral face of the image recording drum 52 for gripping leading edges of the paper P. The image recording drum 52 conveys the paper P towards the ink drying section 20 by rotating with the leading edges of the paper P gripped by the grippers 52A and the paper P wrapped around the peripheral face of the image recording drum 52. The peripheral face of the image recording drum 52 is further provided with multiple suction holes (not shown in the drawings), formed in a specific pattern. The paper P wrapped around the peripheral face of the image recording drum 52 is conveyed whilst being suction-retained on the peripheral face of the image recording drum 52 by the suction of the suction holes. The paper P can accordingly be conveyed with a high degree of flatness.

Note that the suction of the suction holes only acts over a certain range, acting between a specific suction start position and a specific suction end position. The suction start position is set as the disposal position of the paper press roller 54, and the suction end position is set at the downstream side of the disposal position of the inline sensor 58 (for example, set at the position where paper is passed to the ink drying section 20). Namely, setting is made such that the paper P is suction-retained to the peripheral face of the image recording drum 52 at least at the disposal positions of the inkjet heads 56C, 56M, 56Y, 56K (image recording positions) and the disposal position of the inline sensor 58 (image reading position).

The mechanism for suction retention of the paper P to the peripheral face of the image recording drum 52 is not limited to the above negative pressure suction attachment method, and a method employing electrostatic attraction may also be adopted.

The image recording drum 52 of the present exemplary embodiment is disposed with the grippers 52A at two locations on the outer peripheral face, in a configuration capable of conveying two sheets of the paper P with a single rotation. Rotation of the image recording drum 52 and the process liquid drying drum 46 is controlled such that the timings for receiving and passing over the paper P are coordinated with each other. Namely, the image recording drum 52 and the process liquid drying drum 46 are driven such that they have the same peripheral speed, and are driven such that the positions of the grippers are coordinated with each other.

The paper press roller 54 is disposed in the vicinity of the sheet member receiving position of the image recording drum 52 (the position where the paper P is received from the process liquid drying drum 46). The paper press roller 54 is configured from a rubber roller, and is disposed so as to be in press contact with the peripheral face of the image recording drum 52. The paper P that has been passed over to the image recording drum 52 from the process liquid drying drum 46 accordingly makes close contact with the peripheral face of the image recording drum 52 due to being nipped on passing the paper press roller 54.

The four inkjet heads 56C, 56M, 56Y, 56K are disposed at uniform intervals along the conveyance path of the paper P to the side of the image recording drum 52. The inkjet heads 56C, 56M, 56Y, 56K are configured as line heads corresponding to the paper width, with a nozzle face disposed facing the peripheral face of the image recording drum 52. Each of the inkjet heads 56C, 56M, 56Y, 56K record an image on the paper P being conveyed by the image recording drum 52 by jetting liquid ink droplets towards the image recording drum 52 from nozzle rows formed on the nozzle face.

Water-based UV ink is employed for the ink jetted from each of the inkjet heads 56C, 56M, 56Y, 56K. The water-based UV inks can be cured by irradiation with ultraviolet radiation (UV) after droplet impact.

The inline sensor 58 is disposed at the side of the image recording drum 52 on the downstream side of the last of the inkjet heads 56K in the conveyance direction of the paper P. The inline sensor 58 reads the image recorded on the paper P by the inkjet heads 56C, 56M, 56Y, 56K. The inline sensor 58 is for example configured by a line scanner, and reads the image recorded by the inkjet heads 56C, 56M, 56Y, 56K on the paper P being conveyed by the image recording drum 52.

A contact prevention plate 59 is disposed at the conveyance direction downstream side of the inline sensor 58 and adjacent to the inline sensor 58. The contact prevention plate 59 prevents the paper P from making contact with the inline sensor 58 when lifting of the paper P occurs due for example to poor conveyance.

The mist filter 60 is disposed between the last of the inkjet heads 56K and the inline sensor 58 so as to suck in air at the periphery of the image recording drum 52 and capture any ink mist. Ink mist is thereby suppressed from penetrating to the inline sensor 58 due to air being sucked in at the periphery of the image recording drum 52 and ink mist being captured, suppressing the occurrence of for example read errors.

The drum cooling unit 62 blows cool air onto the image recording drum 52, cooling the image recording drum 52. The drum cooling unit 62 is configured to principally include an air conditioner, not shown in the drawings, and a duct 62A to blow cooled air supplied from the air conditioner onto the peripheral face of the image recording drum 52. The duct 62A blows cooled air towards the image recording drum 52 at a region outside a paper P conveyance region, and cools the image recording drum 52. In the present example, the duct 62A is configured to blow cooled air and cool the image recording drum 52 at a region that is substantially the bottom side half of the image recording drum 52, since the paper P is conveyed substantially at the top side half of the circular arc shaped face of the image recording drum 52. More specifically, the outlet of the duct 62A is formed in a circular arc shape so as to cover substantially the lower side half of the image recording drum 52 and is configured to blow cooled air at a region that is substantially the lower side half of the image recording drum 52.

The temperature to which the image recording drum 52 is cooled is set based on a relationship with the temperature of the inkjet heads 56C, 56M, 56Y, 56K (in particular, the temperature of the nozzle face), such that the image recording drum 52 is cooled to a lower temperature than the temperature of the inkjet heads 56C, 56M, 56Y, 56K. Condensation can accordingly be prevented from occurring on the inkjet heads 56C, 56M, 56Y, 56K. Namely, by lowering the temperature of the image recording drum 52 to below that of the inkjet heads 56C, 56M, 56Y, 56K, any condensation can be induced to occur on the image recording drum side, and condensation can be prevented from occurring on the inkjet heads 56C, 56M, 56Y, 56K (in particular, condensation occurring on the nozzle face).

Ink Drying Section

The ink drying section 20 dries the paper P after image recording, and drives off the liquid component remaining on the recording face of the paper P. The ink drying section 20 is configured to principally include: a chain gripper 64 for conveying the paper P on which an image has been recorded; a back tension application mechanism 66 serving as an example of a back tension application section that applies back tension to the paper P being conveyed by the chain gripper 64; and ink drying units 68 serving as an example of drying units for drying the paper P being conveyed by the chain gripper 64.

The chain gripper 64 is a common paper conveyance mechanism employed in the ink drying section 20, the water application section 80, the UV irradiation section 22, and the paper discharge section 24. The chain gripper 64 receives the paper P passed from the image recording section 18 and conveys it as far as the paper discharge section 24.

The chain gripper 64 is configured to principally include: first sprockets 64A disposed in the vicinity of the image recording drum 52; second sprockets 64B provided to the paper discharge section 24; endless chains 64C entrained around the first sprockets 64A and the second sprockets 64B; plural chain guides (not shown in the drawings) for guiding travel of the chains 64C; and plural grippers 64D attached to the chain 64C at uniform intervals. The first sprockets 64A, the second sprockets 64B, the chains 64C and the chain guides are respectively configured in pairs, and are disposed on both width direction sides of the paper P. The grippers 64D are disposed spanning between the pair of chains 64C.

The first sprockets 64A are disposed in the vicinity of the image recording drum 52 so as to be capable of receiving the paper P passed over from the image recording drum 52 with the grippers 64D. The first sprockets 64A are rotatably supported by shaft bearings, not shown in the drawings, and are coupled to a motor, not shown in the drawings. The chains 64C entrained around the first sprockets 64A and the second sprockets 64B are run by driving the motor.

The second sprockets 64B are provided at the paper discharge section 24 so as to be capable of collecting the paper P received from the image recording drum 52 at the paper discharge section 24. Namely, the disposal position of the second sprockets 64B configures the terminal of the paper P conveyance path along the chain gripper 64. The second sprockets 64B are provided rotatably supported by shaft bearings, not shown in the drawings.

The chains 64C are formed with an endless shape, and are entrained around the first sprockets 64A and the second sprockets 64B.

The chain guides are disposed at specific positions, and guide such that the chains 64C travel along a specific path (=guide such that the paper P is conveyed to travel along a specific conveyance path). In the inkjet recording apparatus 10 of the present example, the second sprockets 64B are provided at a position higher than the first sprockets 64A. The chains 64C accordingly form a traveling path that is inclined en route. More specifically, the traveling path is configured from a first horizontal conveyance path 70A, an inclined conveyance path 70B, and a second horizontal conveyance path 70C.

The first horizontal conveyance path 70A is set at a similar height to the first sprockets 64A, and the chains 64C entrained around the first sprockets 64A are set to travel horizontally. The second horizontal conveyance path 70C is set at a similar height to the second sprockets 64B, and the chains 64C entrained around the second sprockets 64B are set to travel horizontally. The inclined conveyance path 70B is set between the first horizontal conveyance path 70A and the second horizontal conveyance path 70C and is set so as to connect the first horizontal conveyance path 70A and the second horizontal conveyance path 70C.

The chain guides are disposed so as to form the first horizontal conveyance path 70A, the inclined conveyance path 70B, and the second horizontal conveyance path 70C. More specifically, the chain guides are disposed at least at a junction point of the first horizontal conveyance path 70A and the inclined conveyance path 70B, and a junction point of the inclined conveyance path 70B and the second horizontal conveyance path 70C.

Plural grippers 64D are attached to the chains 64C at uniform intervals. The attachment intervals of the grippers 64D are set so as to match the intervals between receiving the paper P from the image recording drum 52. Namely, the attachment intervals of the grippers 64D are set so as to match the intervals between receiving the paper P from the image recording drum 52, such that the paper P passed over in sequence from the image recording drum 52 can be received from the image recording drum 52 at a coordinated timing.

The chain gripper 64 is configured as described above. As explained above, the chains 64C travel when the motor (not shown in the drawings) connected to the first sprockets 64A is driven. The chains 64C travel at the same speed as the peripheral speed of the image recording drum 52. Timing is coordinated such that the paper P passed over from the image recording drum 52 can be received by each of the grippers 64D.

Figure 2:
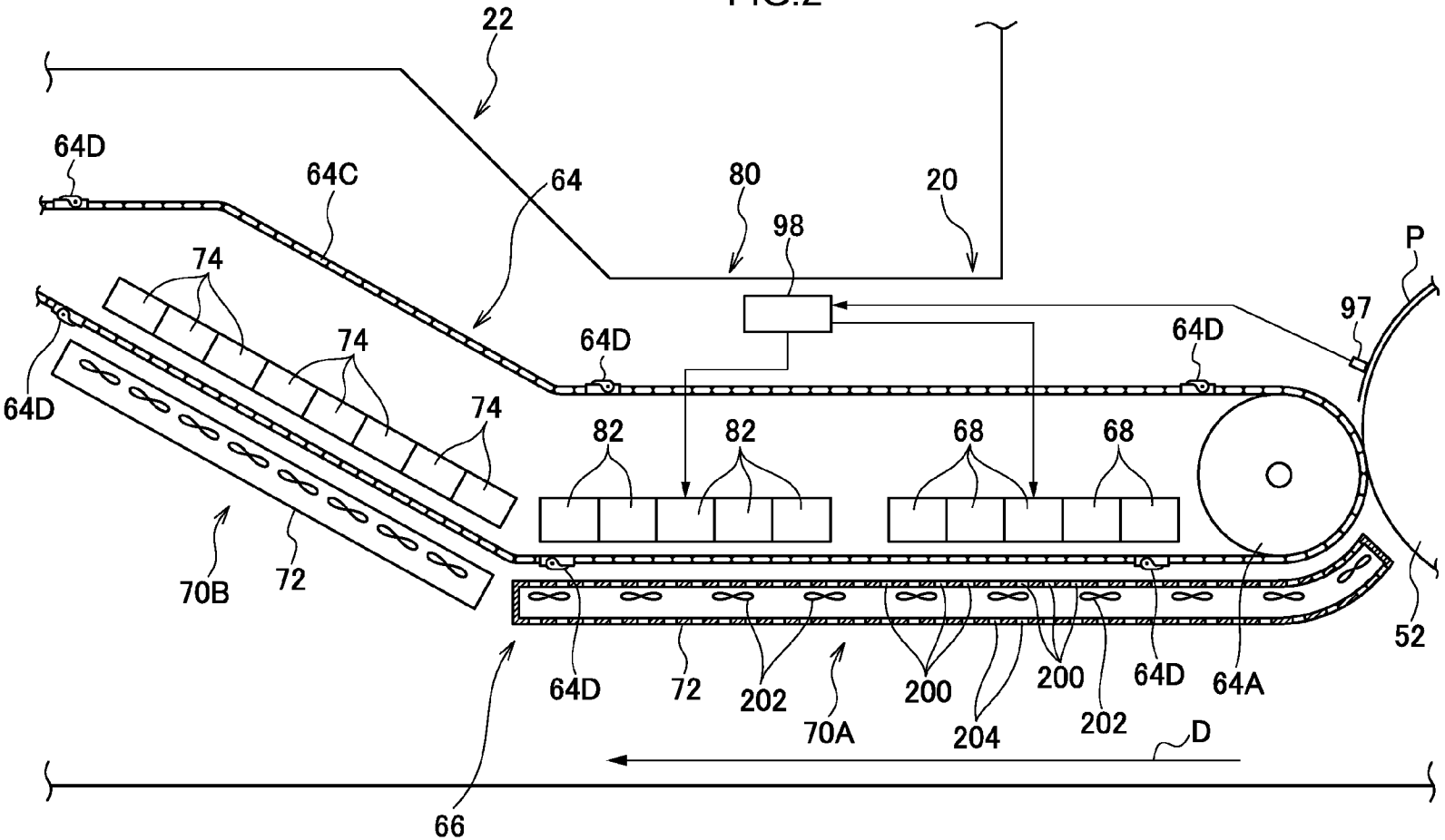
FIG. 2 is an enlarged drawing of an ink drying section, a water application section and a UV irradiation section of an inkjet recording apparatus according to an exemplary embodiment of the present invention.
Figure 3:
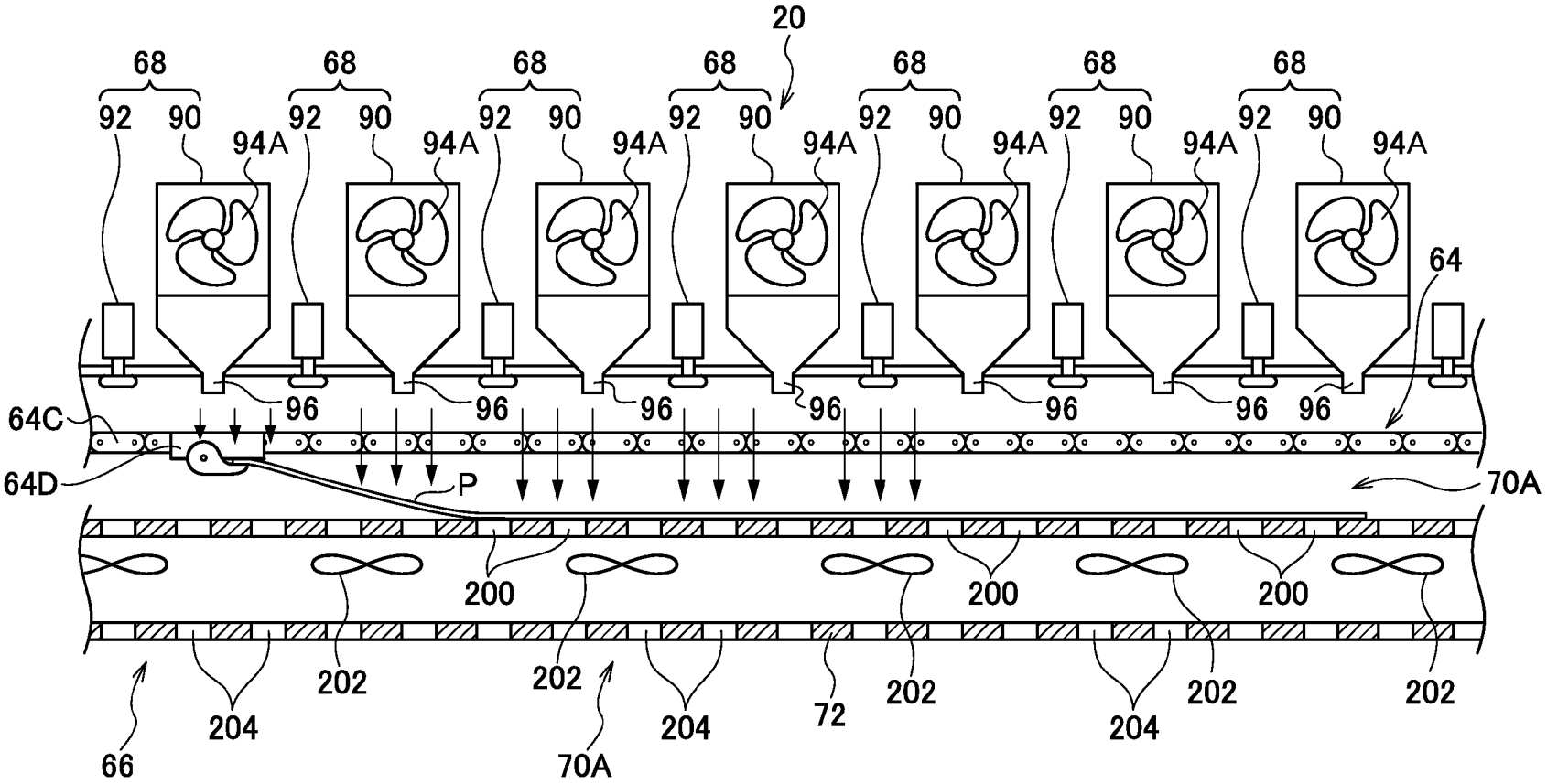
FIG. 3 is a drawing showing a state wherein water-based ultraviolet-curable ink is dried by drying air in the ink drying section whilst paper is being conveyed by a chain gripper.

The back tension application mechanism 66 applies back tension to the paper P being conveyed whilst a leading edge is gripped by the chain gripper 64. As illustrated in FIG. 2 and FIG. 3, the back tension application mechanism 66 is principally provided with a guide plate 72, and plural suction fans 202 that suck in air through multiple suction holes 200 formed in the upper face of the guide plate 72. Multiple holes 204 are provided in the bottom face of the guide plate 72 for expelling the sucked-in air.

The guide plate 72 is configured from a hollow box plate with a width corresponding to the paper width. The guide plate 72 is disposed along the conveyance path of the paper P alongside the chain gripper 64, i.e., the chain travel path. More specifically, the guide plate 72 is disposed along the chains 64C that travel on the first horizontal conveyance path 70A and the inclined conveyance path 70B, disposed at a specific separation distance from the chains 64C. The back face of the paper P (the face on the side not recorded with an image) being conveyed by the chain gripper 64 is conveyed in sliding contact across the upper face of the guide plate 72 (the face that faces the chains 64C: the sliding contact face).

The sliding contact face (upper face) of the guide plate 72 is formed with multiple of the suction holes 200 in a specific pattern. The guide plate 72 is formed from a hollow box plate, as mentioned above. The suction fans 202 create suction in the hollow portion (inside) of the guide plate 72. Air is accordingly sucked through the suction holes 200 formed in the sliding contact face.

The back face of the paper P being conveyed by the chain gripper 64 is sucked against the suction holes 200 due to air being sucked through the suction holes 200 of the guide plate 72. Back tension is accordingly applied to the paper P being conveyed by the chain gripper 64.

As described above, back tension is applied to the paper P while being conveyed along the first horizontal conveyance path 70A and the inclined conveyance path 70B since the guide plates 72 are disposed respectively along the chains 64C that travel along the first horizontal conveyance path 70A and the inclined conveyance path 70B.

As illustrated in FIG. 1, the ink drying units 68 are disposed to the inside of the chain gripper 64 (specifically at the front half side of the location that configures the first horizontal conveyance path 70A). The ink drying units 68 dry the paper P being conveyed along the first horizontal conveyance path 70A. The ink drying units 68 dry the paper P by blowing drying air onto the recording face of the paper P being conveyed along the first horizontal conveyance path 70A. Plural the ink drying units 68 are disposed along the first horizontal conveyance path 70A. The number of the ink drying units 68 provided is set according to such factors as the processing capacity of the ink drying units 68 and the conveyance speed of the paper P, i.e., printing speed. Namely, setting is made such that the paper P received from the image recording section 18 can be dried whilst being conveyed on the first horizontal conveyance path 70A. The length of the first horizontal conveyance path 70A is accordingly also set in consideration of the capacity of the ink drying units 68. Note that the configuration of the ink drying units 68 is described in detail later.

Water Application Section

The water application section 80 is provided to the inside of the chain gripper 64 (specifically, at the back half side of the location that configures the first horizontal conveyance path 70A), and applies water to the paper P being conveyed on the first horizontal conveyance path 70A after it has passed through the ink drying section 20. The water application section 80 is principally configured by the chain gripper 64 that conveys the dried paper P, the back tension application mechanism 66 that applies back tension to the paper P being conveyed by the chain gripper 64, and water application units 82 that apply water to the paper P that is being conveyed by the chain gripper 64 and serve as an example of a water application section. The water application units 82 apply water to the paper P by for example spraying fine droplets of water onto the paper P. The amount of moisture in the paper P is accordingly regulated. Plural of the water application units 82 are disposed along the first horizontal conveyance path 70A. The number of water application units 82 provided is set according to for example the capacity of the water application units 82 and the conveyance speed of the paper P, i.e., printing speed. Namely, setting is made such that after the paper P has been dried by the ink drying units 68, the paper P can be applied with a specific amount of moisture whilst being conveyed on the first horizontal conveyance path 70A.

UV Irradiation Section

The UV irradiation section 22 irradiates ultraviolet radiation (UV) onto images recorded using the water-based UV ink, so as to fix the images. The UV irradiation section 22 is configured so as to principally include the chain gripper 64 to convey the paper P, the back tension application mechanism 66 to apply back tension to the paper P being conveyed by the chain gripper 64, and UV irradiation units 74 serving as examples of a fixing unit that irradiates ultraviolet radiation onto the paper P being conveyed by the chain gripper 64.

As described above, the chain gripper 64 and back tension application mechanism 66 here are also commonly employed over the ink drying section 20, the water application section 80 and the paper discharge section 24.

The UV irradiation units 74 are disposed to the inside of the chain gripper 64 (specifically at a location that configures the inclined conveyance path 70B), and irradiates ultraviolet radiation onto the recording face of the paper P being conveyed on the inclined conveyance path 70B. The UV irradiation units 74 are provided with an ultraviolet lamp (UV lamp), and plural of the UV irradiation units 74 are disposed along the inclined conveyance path 70B. The UV irradiation units 74 irradiate ultraviolet radiation onto the recording face of the paper P being conveyed on the inclined conveyance path 70B. The number of the UV irradiation units 74 provided is set according to for example to the conveyance speed of the paper P, i.e., printing speed. Namely, setting is made such that images can be fixed by ultraviolet radiation irradiation whilst the paper P is being conveyed on the inclined conveyance path 70B. The length of the inclined conveyance path 70B is accordingly also set in consideration of for example the conveyance speed of the paper P.

Paper Discharge Section

The paper discharge section 24 collects the paper P that has been subjected to a cycle of image recording processing. The paper discharge section 24 is configured so as to principally include the chain gripper 64 for conveying the UV irradiated paper P, and a paper discharge plate 76 for stacking and collecting the paper P.

As described above, the chain gripper 64 here is also commonly employed over the ink drying section 20 and the UV irradiation section 22. The chain gripper 64 releases the paper P over the paper discharge plate 76, stacking the paper P on the paper discharge plate 76.

The paper discharge plate 76 stacks and collects the paper P released from the chain gripper 64. The paper discharge plate 76 is provided with paper stops (for example a front paper stop, a rear paper stop, and side paper stops) (not shown in the drawings) in order to stack the paper P neatly.

The paper discharge plate 76 is equipped with a paper discharge plate raising and lowering device, not shown in the drawings, that is capable of raising and lowering the paper discharge plate 76. The paper discharge raising and lowering device is coupled to increases and decreases in the amount of paper stacked in the paper discharge plate 76, with drive controlled so that the paper discharge plate 76 is raised and lowered such that the uppermost sheet of paper P is positioned at a constant height.

Detailed Description of the Image Recording Section, the Ink Drying Section, the Water Application Section and the UV Irradiation Section More detailed explanation follows regarding the image recording section 18, the ink drying section 20, the water application section 80 and the UV irradiation section 22 that are relevant portions of the inkjet recording apparatus 10 of the present exemplary embodiment. FIG. 2 is an enlarged drawing of the ink drying section 20, the water application section 80 and the UV irradiation section 22 of the inkjet recording apparatus 10 of an exemplary embodiment of the present invention. FIG. 3 is a drawing showing a state in which water-based ultraviolet-curable ink is being dried by drying air in the ink drying section 20 whilst the paper is being conveyed by a chain gripper.

As illustrated in FIG. 1, each of the inkjet heads 56C, 56M, 56Y, 56K jet droplets of ink (water-based UV ink) of the corresponding color towards the recording face of the paper P that is being retained in tight contact on the image recording drum 52 in the image recording section 18. The ink lands on the process liquid that has been pre-applied to the recording face in the process liquid application section 14, and the coloring matter (pigment) dispersed in the ink aggregates, forming an aggregate body of coloring material. The coloring material is thereby prevented from running on the paper P, and an image is formed on the recording face of the paper P.

As illustrated in FIG. 2 and FIG. 3, the paper P being conveyed by the chain gripper 64 is dried by the ink drying units 68 in the ink drying section 20. Namely, the ink drying section 20 is a mechanism that dries moisture included in the solvent that has been separated in the coloring material aggregation process, and is provided with plural ink drying units 68 each arranged with an IR heater 92 at a position facing the paper P being conveyed by the chain gripper 64, and a drying device 90, described later.

The chain gripper 64 grips a leading edge of each sheet of paper P with the grippers 64D and conveys the paper P along the flat-faced guide plate 72, and drying is performed by the ink drying units 68 disposed to the inside of the chain gripper 64. When this is being performed the paper P is being conveyed with back tension applied by the back tension application mechanism 66 so that creases do not occur, and being dried by drying air from the ink drying units 68. Curling and cockling of the paper P is accordingly suppressed.

As illustrated in FIG. 3, the drying devices 90, described in detail later, are each provided with external air intake fans 94A for introducing external air inside the drying device 90 from outside the of the inkjet recording apparatus 10, and a drying air blowing nozzle 96. The drying air blowing nozzle 96 is configured to increase the rate of airflow of drying air containing external air introduced from outside into the drying device 90 controlled to a specific temperature, and to blow the drying air onto the recording face of the paper P. The IR heaters 92 are respectively controlled to a specific temperature, and warm the inside of the first horizontal conveyance path 70A. The drying air blowing nozzles 96 and the IR heaters 92 perform drying by evaporating moisture contained in the recording face of the paper P.

As illustrated in FIG. 2, an ink quantity detection sensor 97 that detects an amount of ink jetted onto the recording face of the conveyed paper P is provided facing the peripheral face of the image recording drum 52 at a position further to the (conveyance direction D) downstream side of the image recording drum 52 than the inkjet heads 56C, 56M, 56Y, 56K.

A signal detected by the ink quantity detection sensor 97 is input to a controller 98. The controller 98 includes a CPU and memory and the like, and controls the airflow rate of the external air intake fan 94A according to the amount of drying the paper P requires, namely according to the input signal (ink amount). More specifically, as for example illustrated in Table 1 below, if the input ink amount is lower than a given standard value (a normal amount), the controller 98 reduces the airflow rate by reducing the rotation speed of the external air intake fans 94A. If the input ink amount is significantly lower than the given standard value (the normal amount), the controller 98 greatly reduces the airflow rate by greatly reducing the rotation speed of the external air intake fans 94A. If the input ink amount is the given standard value (the normal amount), the controller 98 performs control for a normal airflow rate by setting the rotation speed of the external air intake fans 94A to a standard value rotation speed. If the input ink amount is higher than the given standard value (the normal amount), the controller 98 performs control to increase the airflow rate by increasing the rotation speed of the external air intake fans 94A.

TABLE 1

| Ink Amount | Rotation speed (Airflow Rate) |
|---|---|
| High | High |
| Normal (Standard) | Normal (Standard) |
| Low | Low |
| Very low | Very low |

After the paper P has been dried in the ink drying section 20, water is applied to the paper P being conveyed by the chain gripper 64 by the water application units 82 in the water application section 80. The water application units 82 apply water such that the amount of moisture included in the paper P lies within a desired range. The amount of moisture in the paper P is accordingly regulated such that the paper P is not over dried by the ink drying section 20. Water is applied to the paper P by the water application units 82 whilst back tension is being applied to the paper P by the back tension application mechanism 66.

In the present exemplary embodiment, configuration is made such that water is applied from above the paper P downwards onto the recording face side of the paper P by the water application units 82. Water can be applied more evenly to the paper P due to the water being applied from above the paper P downwards by the water application units 82. Note that the "water" applied to the paper P by the water application units 82 encompasses liquids having water as a main component. For example, this includes cases in which a liquid applied to the paper P by the water application units 82 is water with additives such as preservatives.

The image is fixed in the UV irradiation section 22 by irradiating ultraviolet radiation (UV) from the UV irradiation units 74 onto images recorded on the recording face of the paper P employing water-based UV inks. The UV irradiation units 74 may employ plural ultraviolet radiation sources. Reducing the irradiation intensity of each of the ultraviolet radiation sources allows curing conditions to be achieved by irradiation duration and for a reduction in cost and amount of heat generated by the UV irradiation units 74 to be achieved.

The ultraviolet radiation sources employed in the UV irradiation units 74 are not particularly limited, and examples thereof that may be applied include metal halide lamps, mercury lamps, excimer lasers, ultraviolet lasers, black lights, cold-cathode tubes, LEDs, and laser diodes. Metal halide lamp tubes, mercury lamp tubes or black lights, for example, are preferably employed.

Detailed Description of the Drying Devices

Figure 4:
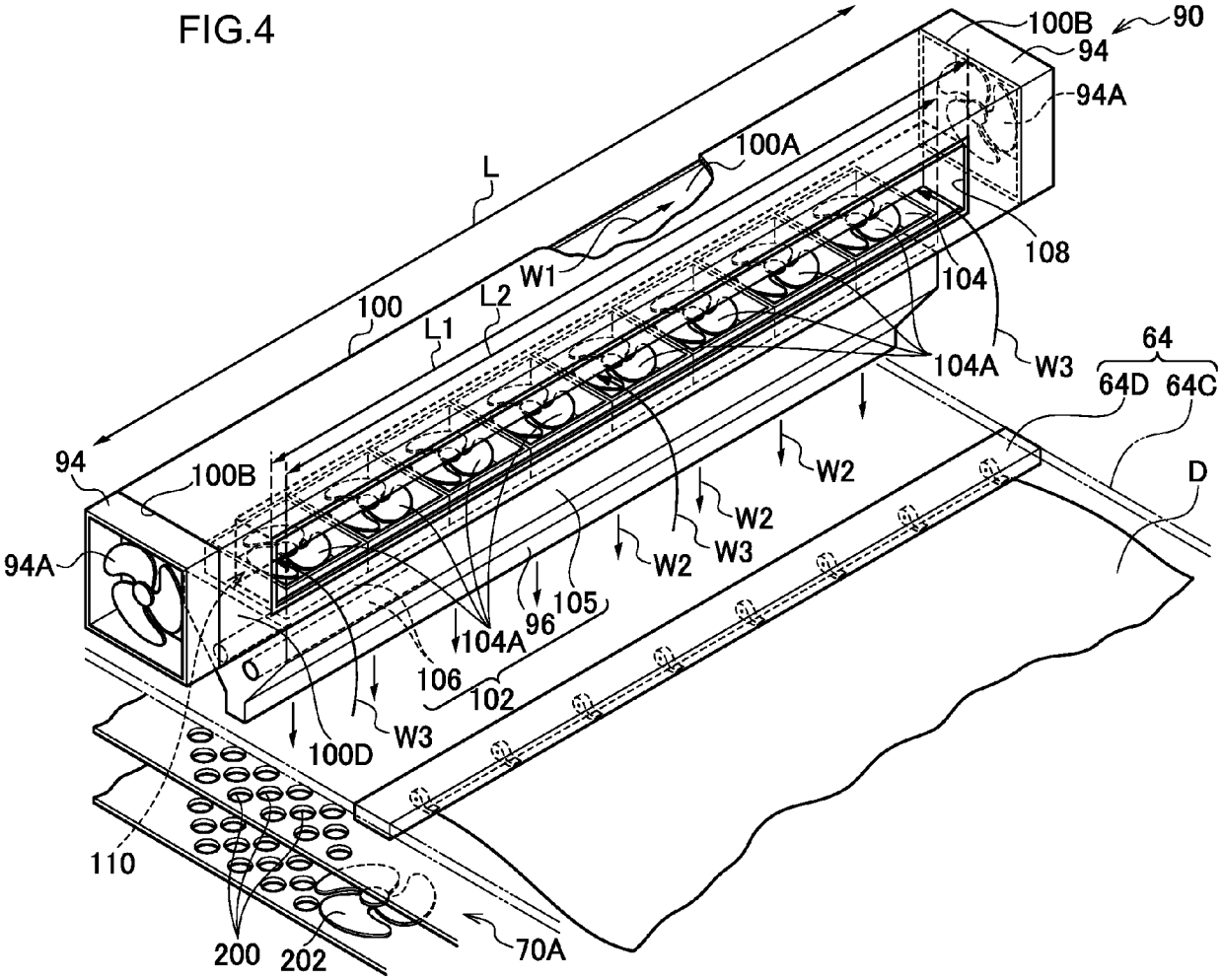
FIG. 4 is a schematic drawing of a drying device.
Figure 5:
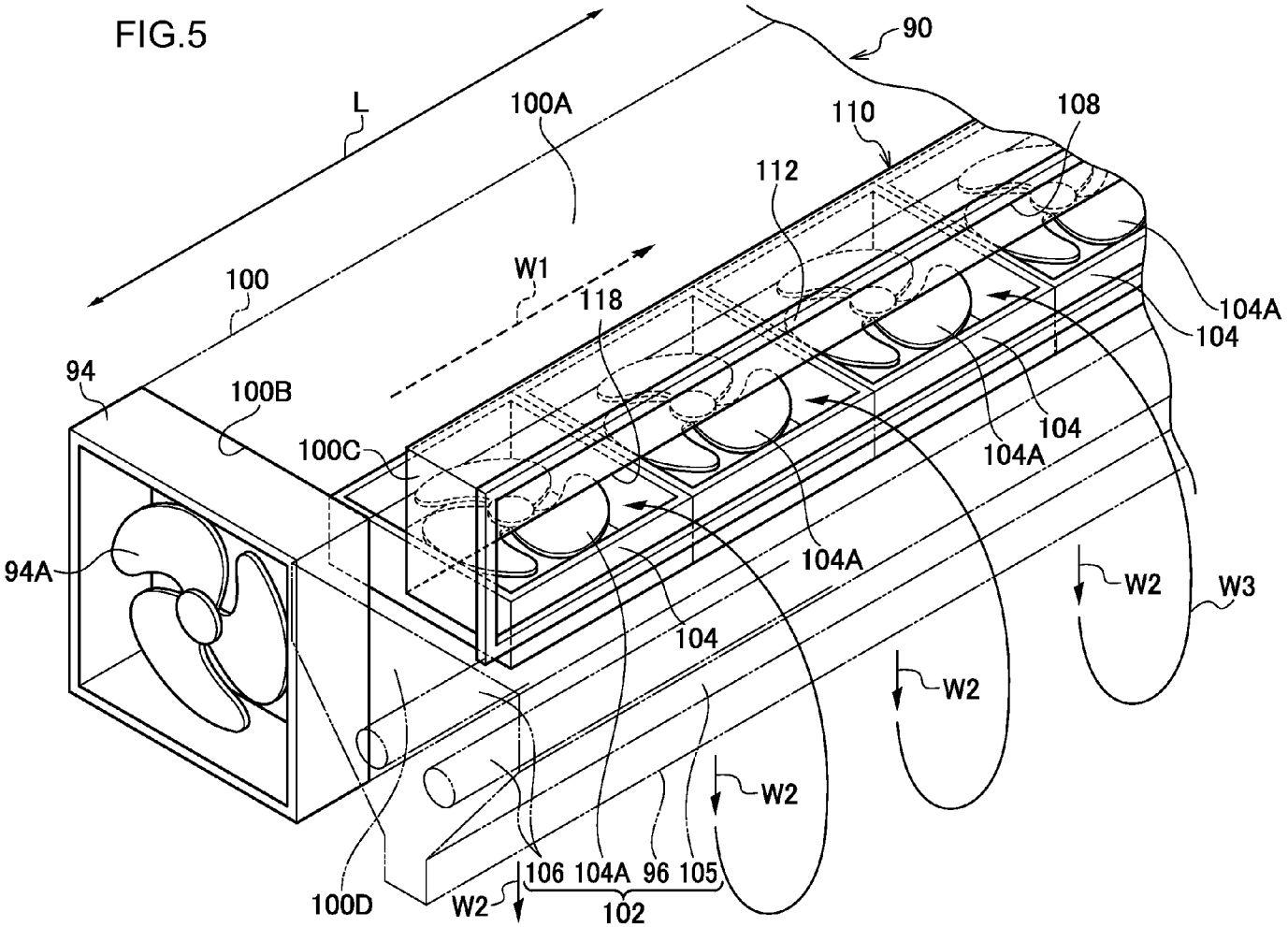
FIG. 5 is an enlarged drawing showing an enlarged portion of the drying device in FIG. 4, with a portion of the internal configuration of the drying device shown by solid lines.
Figure 6:
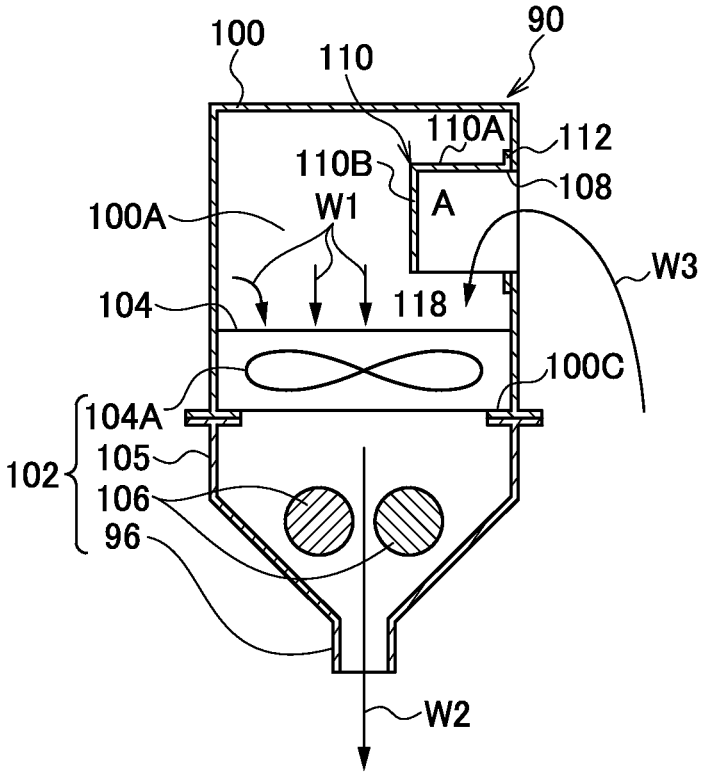
FIG. 6 is a side-on cross-section of the drying device in FIG. 4.

Explanation follows regarding the drying devices 90 of the present exemplary embodiment. FIG. 4 is a schematic drawing of one of the drying devices 90. FIG. 5 is an enlarged drawing of part of the drying device 90 illustrated in FIG. 4, showing a portion of the internal configuration of the drying device 90 in solid lines. FIG. 6 is a cross-section of the drying device 90 illustrated in FIG. 4, viewed from the side.

Each of the drying devices 90 includes a duct 100, the external air intake fans 94A, and heating and blowing sections 102. Each heating and blowing section 102 is provided with a fan 104A, a heating box 105, infrared heaters 106 and the drying air blowing nozzle 96. Each configuration element is explained below.

The duct 100 faces towards the first horizontal conveyance path 70A, extends in a direction orthogonal to the first horizontal conveyance path 70A, and is disposed so as to protrude out widthwise between the chains 64C that circulate around the outside of the drying device 90. The duct 100 is a tube body with a rectangular cross-section with the inside configuring an airflow path 100A.

Both end portions 100B of the duct 100 are connected to fan boxes 94 respectively provided with the axial flow type external air intake fans 94A. The fan boxes 94 are attached to air intake openings (not shown in the drawings) formed in the housing of the inkjet recording apparatus 10. Accordingly, fresh air from outside the inkjet recording apparatus 10 is forced into the airflow path 100A when the external air intake fans 94A are driven. Currents of external air are accordingly created inside the airflow path 100A, in directions orthogonal to the first horizontal conveyance path 70A.

Note that "external air" generally has a lower temperature and lower moisture content than air inside the inkjet recording apparatus 10 (internal air), for example having a temperature between 20° C. and 30° C. and a moisture content of 60% or less.

The bottom face of the duct 100 is open (opening 100C in FIG. 6), and the plural fans 104A that are rotatably supported in frames 104 are disposed along the length direction L of the airflow path 100A. The heating box 105 of funnel-shaped cross-section is attached below the fans 104A. A pair of the infrared heaters 106 is disposed extending in the length direction L of the airflow path 100A inside the heating box 105. A bottom opening of the heating box 105 is constricted and extends in the length direction L, forming the drying air blowing nozzle 96.

Accordingly, external air in the airflow path 100A that is taken into the heating box 105 by the plural fans 104A is heated by the infrared heaters 106 and is blown out of the drying air blowing nozzle 96 as drying air W2.

A side wall 100D on the first horizontal conveyance path 70A upstream side of the duct 100 is formed with a rectangular circulation opening 108 extending along the length direction L of the duct 100.

As illustrated in FIG. 4, a length L1 of the circulation opening 108 is formed longer than a length L2 of the row of frames 104 housing the fans 104A, in a configuration such that recirculated air W3 is drawn evenly through the circulation opening 108 by the fans 104A. As illustrated in FIG. 6, a hood 110, serving as a partitioning plate, and provided with a horizontal side 110A extending horizontally from an upper opening edge of the circulation opening 108 towards the inside of the airflow path 100A and a vertical side 110B bending around from the leading edge of the horizontal side 110A towards the fans 104A, is attached to the circulation opening 108 through a flange 112.

The hood 110 is provided extending along the length direction L, and a space inside the hood 110, namely a space A enclosed by the circulation opening 108 and the hood 110 as illustrated in FIG. 6, is closed off by sealing plates 110C (see FIG. 5) at both end portions of the hood 110, such that external air introduced by the external air intake fans 94A does not cut across along the length direction L inside of the hood 110.

Operation

Figure 7A:
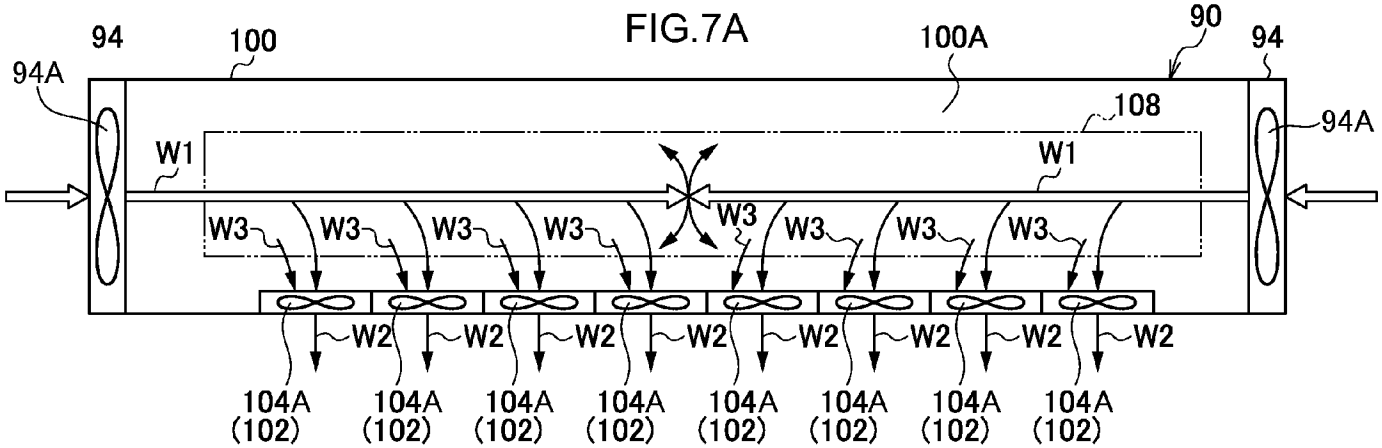
FIG. 7A and FIG. 7B are drawings to explain operation of a drying device according to an exemplary embodiment of the present invention.
Figure 7B:
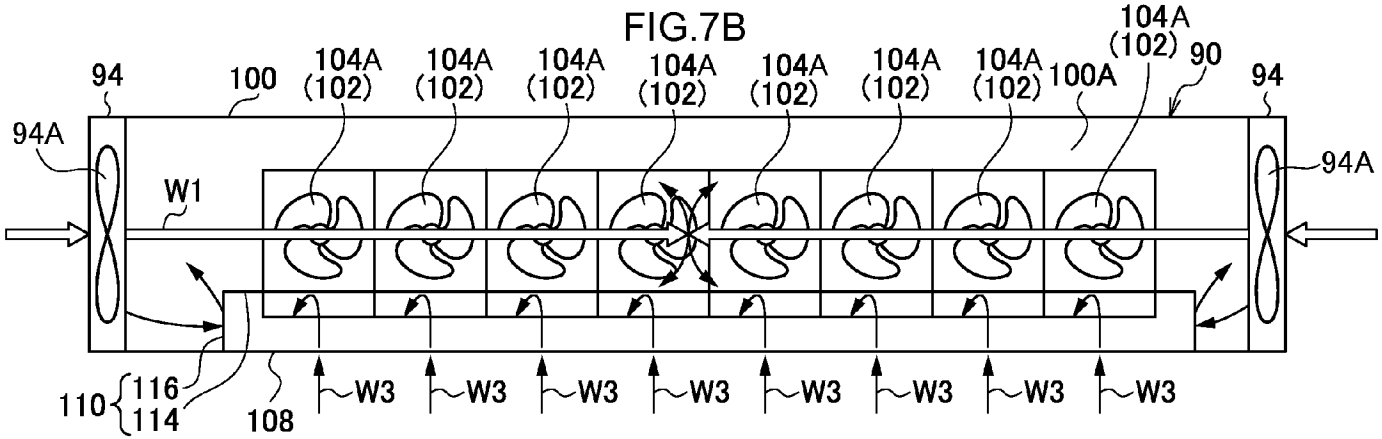

Explanation follows regarding operation and advantageous effects of the drying device 90 and the inkjet recording apparatus 10 according to an exemplary embodiment of the present invention. FIG. 7A and FIG. 7B are drawings explaining the operation of the drying device 90 according to an exemplary embodiment of the present invention. Note that certain elements including the drying air blowing nozzle 96 and infrared heaters 106 of the drying device 90 are omitted from illustration in FIG. 7A and FIG. 7B.

As illustrated in FIG. 7A and FIG. 7B, in the drying device 90 of the present exemplary embodiment, external air (fresh air W1) introduced into the airflow path 100A by the external air intake fans 94A forms a current of fresh air W1 in the airflow path 100A. Due to the fans 104A and the infrared heaters 106 provided along the airflow path 100A, the current of fresh air W1 is blown onto the recording face of the conveyed paper P as drying air W2. An even airflow rate can be achieved across the paper P width direction due to blowing the drying air W2 onto the recording face of the paper P with the plural fans 104A disposed in the length direction L.

Further, an increase in the moisture content of the drying air W2 can be suppressed due to employing the fresh air W1 in the drying air W2.

In the drying device 90 according to the present exemplary embodiment, the amount of electricity used by the infrared heaters 106 is cut and energy efficiency improved, since some of the drying air W2 blown out towards the paper recording face is taken back into the airflow path 100A through the circulation opening 108 and recirculated as recirculated air W3.

Note that since the drying air W2 can absorb moisture in the first horizontal conveyance path 70A before being taken back into the airflow path 100A through the circulation opening 108 as recirculated air W3, the recirculated air W3 has higher moisture content than the drying air W2 blown out. However, since the drying air W2 is a mixture of recirculated air W3 and external air (fresh air W1) introduced by the external air intake fans 94A, the drying air W2 has a lower moisture content than in cases such as an internal recirculation methods, where only internal air (recirculated air W3) is used in the drying air W2.

In the drying device 90 of the present exemplary embodiment, the hood 110 that partitions the drying air W2 circulating to the circulation opening 108 and the fresh air W1 introduced to the airflow path 100A is provided to the circulation opening 108.

Figure 8A:
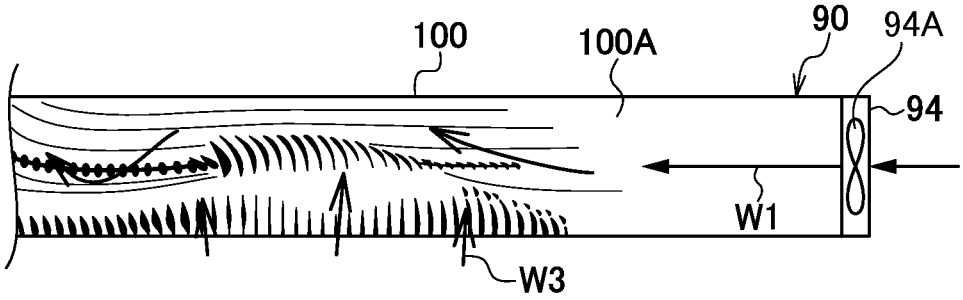
FIG. 8A is a drawing showing results of a simulation of how air flows in an airflow path with no partitioning plate present at a circulation opening.
Figure 8B:
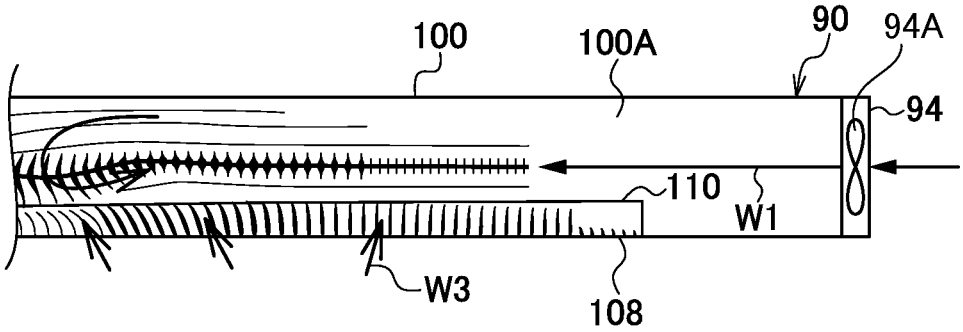
FIG. 8B shows results of a simulation of how air flows in an airflow path when a partitioning plate is present at a circulation opening.

FIG. 8A illustrates the results of a simulation of how each type of air flows inside the airflow path 100A when the hood 110 is not present at the circulation opening 108. FIG. 8B illustrates the results of a simulation of how each type of air flows inside the airflow path 100A when the hood 110 is present at the circulation opening 108.

As illustrated in FIG. 8A, it can be seen that when the hood 110 is not present at the circulation opening 108, the recirculated air W3 pushes up the fresh air W1, with the recirculated air W3 circulating in the airflow path 100A and the fresh air W1 introduced by the external air intake fans 94A interfering with each other.

On the other hand, as illustrated in FIG. 8B, it can be seen that when the hood 110 is present at the circulation opening 108, the fresh air W1 is not readily pushed up by the recirculated air W3, and the recirculated air W3 circulating in the airflow path 100A and the fresh air W1 introduced by the external air intake fans 94A do not interfere with each other. In the present exemplary embodiment, the flow of air in the airflow path 100A is not disrupted, and the mixture ratio of the fresh air W1 and the recirculated air W3 can be made uniform along the length direction L of the airflow path 100A, since the recirculated air W3 and the fresh air W1 do not interfere with each other.

Note that this simulation employs an embodiment wherein external air intake fans are provided at both end openings of the airflow path.

As illustrated in FIG. 7B, in the drying device 90 of the present exemplary embodiment, the recirculated air W3 taken into the airflow path 100A through the circulation opening 108 hits the hood 110 (the vertical side 110B) that faces the circulation opening 108, and the airflow direction is deflected towards the fans 104A side. The fresh air W1 introduced to the airflow path 100A from the external air intake fans 94A hits the sealing plates 110C and is not introduced inside the hood 110. Accordingly, the recirculated air W3 circulating inside the airflow path 100A and the fresh air W1 introduced by the external air intake fans 94A start mixing together in the vicinity of the fans 104A, allowing the mixture ratio of the fresh air W1 and the recirculated air W3 to be made more uniform along the length direction L of the airflow path 100A than in cases in which the sealing plates 110C are not present.

Moisture content increases at the first horizontal conveyance path 70A downstream side of the airflow path 100A, by the amount of moisture evaporated from the paper P as drying progresses. In the drying device 90 of the present exemplary embodiment, the circulation opening 108 is formed at the first horizontal conveyance path 70A upstream side of the airflow path 100A. Accordingly, drying air W2 (recirculated air W3) can be taken into the airflow path 100A through the circulation opening 108 with a lower moisture content than in cases in which the circulation opening 108 is formed at the first horizontal conveyance path 70A downstream side of the airflow path 100A.

In the drying device 90 of the present exemplary embodiment, the circulation opening 108 is formed with a size such that the respective plural fans 104A provided along the length direction L take in the recirculated air W3 evenly. Accordingly, the amount of recirculated air W3 contained in the drying air W2 that is blown onto the paper P can be made more even across the width direction.

In the drying device 90 of the present exemplary embodiment, since fresh air W1 is introduced from both sides of the airflow path 100A by the external air intake fans 94A and collides in the middle of the airflow path 100A. More uniform flow (see FIG. 7A) is achieved than in cases where fresh air W1 is introduced at one side of the airflow path 100A (see FIG. 9A). Accordingly, the amount of fresh air W1 contained in the drying air W2 blown onto the paper P by the fans 104A can be made more uniform across the width direction.

As illustrated in FIG. 6, in the drying device 90 of the present exemplary embodiment, the airflow rate of the drying air W2 is accelerated and the water vapor removal efficiency is improved due to providing the drying air blowing nozzle 96 below the fans 104A.

In the drying device 90 of the present exemplary embodiment, since the airflow path 100A disposed inside of the circulating chains 64C protrudes in the width direction out from between the chains 64C, external air can be introduced even though the chains 64C are present.

The inkjet recording apparatus 10 of the present exemplary embodiment includes the drying devices 90 described above, and the inkjet heads 56C, 56M, 56Y, 56K, that jet ink onto the recording face of the paper P to render an image, provided at the first horizontal conveyance path 70A upstream side of the drying devices 90. The recording face of the paper P jetted with ink from the inkjet heads 56C, 56M, 56Y, 56K can accordingly be dried uniformly across the width direction by the drying devices 90.

The inkjet recording apparatus 10 of the present exemplary embodiment also includes the controller 98 that controls the airflow rate of the external air intake fans 94A according to the amount of ink jetted onto the paper P. The controller 98 accordingly controls, for example, to reduce the airflow rate when the jetted ink amount is lower than a standard value, and controls to increase the airflow rate when the ink jetting amount is denser than a standard value. Energy efficiency of the external air intake fans 94A is thereby raised whilst also drying the paper P reliably.

MODIFIED EXAMPLES

Detailed explanation has been given regarding a particular exemplary embodiment of the present invention, however the present invention is not limited to this exemplary embodiment and it would be clear to a practitioner skilled in the art that various exemplary embodiments are possible within the scope of the present invention. Appropriate combinations from the plural exemplary embodiments described above may also be implemented. Appropriate combinations with the following modified examples may also be implemented.

For example, explanation has been given regarding a case wherein the airflow path 100A extends in a direction orthogonal to the first horizontal conveyance path 70A, however it is sufficient for the airflow path 100A to intersect with the conveyance path.

Figure 9A:
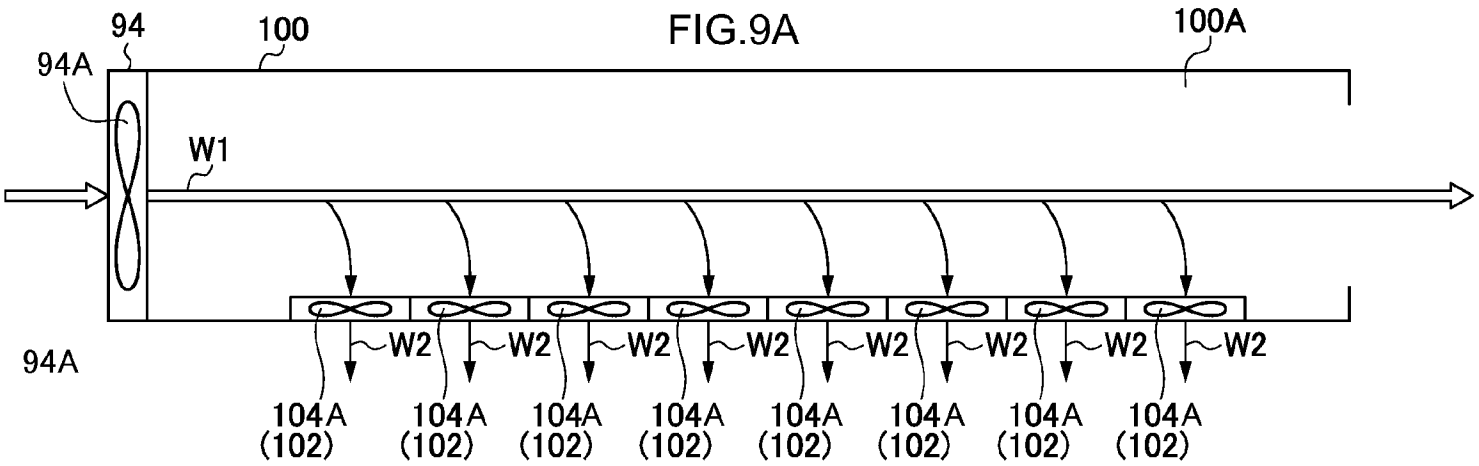
FIG. 9A is a drawing of a modified example of an external air intake fan.

As illustrated in FIG. 9A, a configuration may be adopted wherein fresh air W1 is introduced into the airflow path 100A with an external air intake fan 94A only provided at one side of the airflow path 100A. In such cases, the rate at which drying air W2 blown onto the paper P from the fans 104A provided along the length direction L of the airflow path 100A can still be made uniform across the width direction since the fresh air W1 flows in the airflow path 100A at the introduction strength. Note that in such cases, the other side of the airflow path 100A may be closed off, however it is preferable for the other side of the airflow path 100A to be open, as illustrated in FIG. 9A, in consideration of an internal pressure increase that might arise.

Figure 9B:
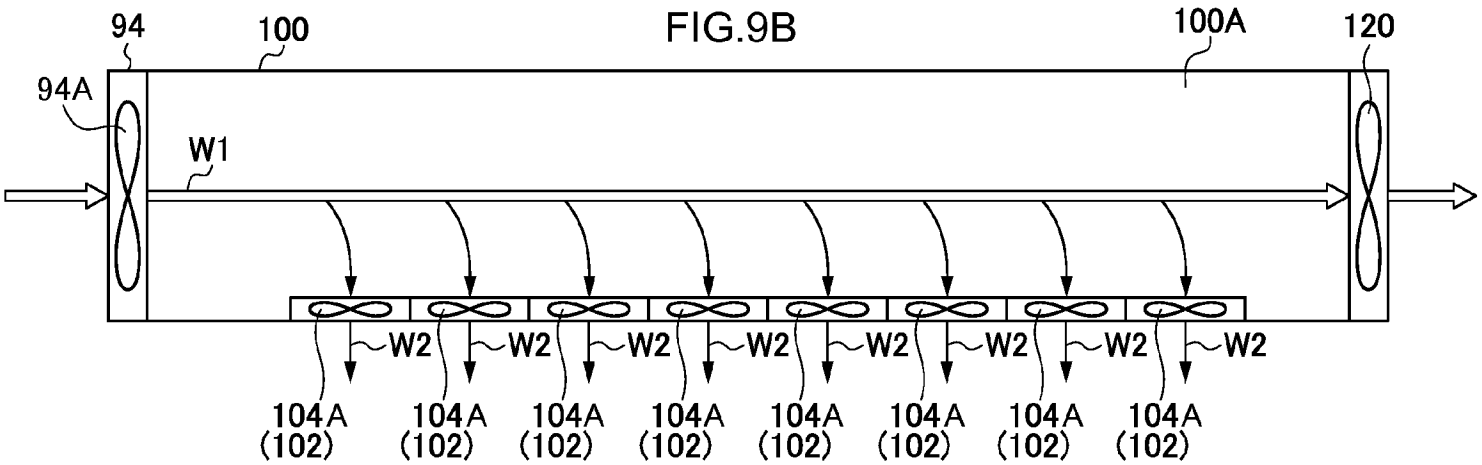
FIG. 9B is a drawing of a modified example of an external air intake fan.

As illustrated in FIG. 9B, the external air intake fan 94A may be provided to a first side of the airflow path 100A, and an external air discharge fan 120 may be provided to the other side of the airflow path 100A to discharge the external air (fresh air W1) introduced into the airflow path 100A. In such cases, the fresh air W1 travels through the airflow path 100A with a desirable strength, and the rate at which the drying air is W2 blown onto the paper P by the fans 104A provided along the length direction L of the airflow path 100A can be made uniform across the width direction. Interference within the fresh air W1 and contact with the path walls can be avoided in comparison to the flow of fresh air W1 illustrated in FIG. 7A, and disruption of the fresh air W1 can be suppressed.

Explanation has been given of a case in which the external air intake fans 94A are axial-flow fans, however centrifugal fans may be employed. Blowers may be used in place of fans to introduce external air, and what is referred to as a bladeless fan, that does not have revolving blades, may also be employed.

Explanation has been given regarding a case where the circulation opening 108 is provided to the airflow path 100A, however the circulation opening 108 may be omitted. Explanation has also been given regarding a case where the hood 110 is provided to the circulation opening 108, however the hood 110 may be omitted. Note that if the circulation opening 108 is provided but the hood 110 is omitted, the flow of fresh air W1 in the airflow path 100A is liable to be disrupted. However even such cases enable drying air W2 to be blown onto the paper P from the heating and blowing section 102 at a more uniform rate across the width direction than cases in which the external air intake fans 94A are not provided.

Figure 10A:
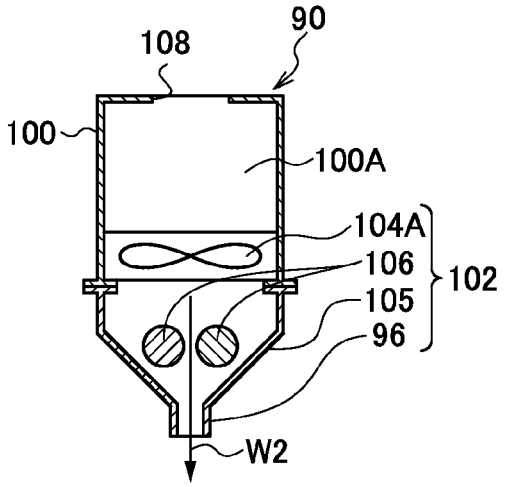
FIG. 10A is a drawing of a modified example of a circulation opening.

Explanation has been given regarding a case in which the circulation opening 108 is provided to the side wall 100D that is on the first horizontal conveyance path 70A upstream side of the duct 100, namely the wall on the first horizontal conveyance path 70A upstream side of the airflow path 100A. However the circulation opening 108 may be provided to the wall on the first horizontal conveyance path 70A downstream side of the airflow path 100A. Moreover, the circulation opening 108 may be provided to an upper wall of the airflow path 100A, as illustrated in FIG. 10A. However, more drying air W2 (recirculated air W3) can be taken in through the circulation opening 108, if the circulation opening 108 is provided on the first horizontal conveyance path 70A upstream side or downstream side (namely, on the conveyance direction D sides) of the airflow path 100A since there is less distance between the first horizontal conveyance path 70A and the circulation opening 108. Moreover, drying air W2 can be taken in at a higher temperature when so configured.

Figure 10B:
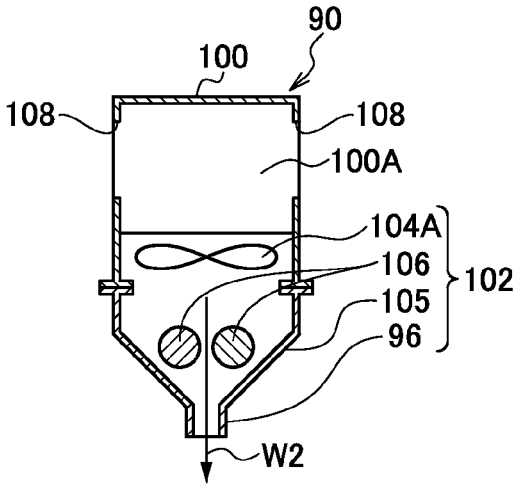
FIG. 10B is a drawing of a modified example of a circulation opening.
Figure 10C:
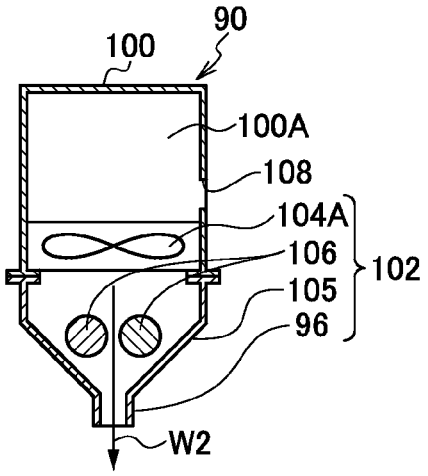
FIG. 10C is a drawing of a modified example of a circulation opening.

Further, as illustrated in FIG. 10B, circulation openings 108 may also be respectively provided to the first horizontal conveyance path 70A downstream side wall and upstream side wall of the airflow path 100A. Explanation has been given regarding a case wherein the circulation opening 108 is provided at a height direction central portion of the airflow path 100A, however the circulation opening 108 may be provided to a height direction bottom end portion (the end portion on the heating and blowing section 102 side) of the airflow path 100A, as illustrated in FIG. 10C. In such cases, more drying air W2 (recirculated air W3) can be taken into the circulation opening 108 since there is less distance between the first horizontal conveyance path 70A and the circulation opening 108. Moreover, drying air W2 can be taken in at a higher temperature. The recirculated air W3 that has entered the airflow path 100A through the circulation opening 108 and the fresh air W1 are also taken into the fans 104A with hardly any time for the recirculated air W3 and the fresh air W1 to mix, since the distance between the circulation opening 108 and the fans 104A is reduced. The flow of the fresh air W1 is accordingly not disrupted even when the recirculated air W3 enters the airflow path 100A.

Explanation has been given of a case in which the hood 110 includes the flange 112 and the two sealing plates 110C, however the flange 112 or either one of the two sealing plates 110C may be omitted from the hood 110. The fresh air W1 does not readily enter the hood 110 as long as there is one sealing plate 110C provided to the hood 110.

Figure 11A:
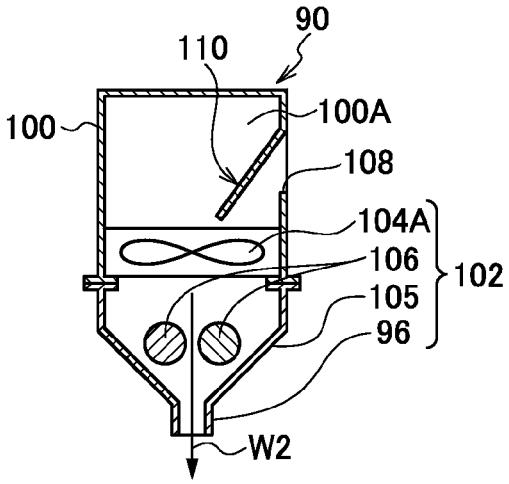
FIG. 11A is a drawing of a modified example of a partitioning plate.
Figure 11B:
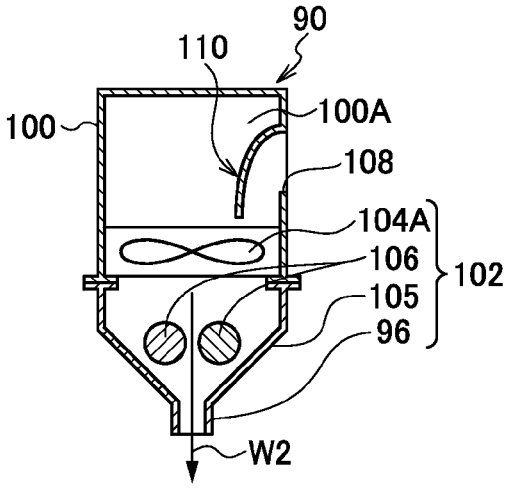
FIG. 11B is a drawing of a modified example of a partitioning plate.
Figure 11C:
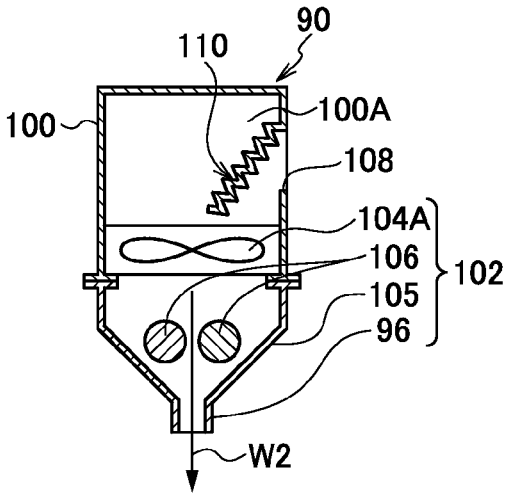
FIG. 11C is a drawing of a modified example of a partitioning plate.

Explanation has been given of a configuration of the hood 110 (with the hood 110 bending around at a right angle) similar to that illustrated in FIG. 6. However as illustrated in FIG. 11A, a configuration may be employed wherein the hood 110 is inclined from an edge portion of the circulation opening 108 towards the fans 104A. Also, as illustrated in FIG. 11B, a configuration may be employed wherein the hood 110 is inclined so as to describe a line curving from the edge portion of the circulation opening 108 towards the fans 104A. As illustrated in FIG. 11C, a configuration may be employed wherein the hood 110 is inclined from the edge portion of the circulation opening 108 towards the fans 104A in a concertina pattern.

Although not shown in the drawings, the faces of the sealing plates 110C facing the external air intake fans 94A may be inclined towards the fans 104A side. In such cases, the fresh air W1 hitting the sealing plates 110C can flow straight into the fans 104A, making the flow of the fresh air W1 less readily disrupted overall.

The evaporated moisture in the first horizontal conveyance path 70A may be expelled along with the drying air W2 to the outside of the inkjet recording apparatus 10 by an exhaust section, not shown in the drawings. In such cases, the amount of moisture contained in the recirculated air W3 can be suppressed.

Explanation has been given regarding a case wherein the drying devices 90 are provided further to the conveyance direction D downstream side than the inkjet heads 56C, 56M, 56Y, 56K, however the drying devices 90 may be provided further to the conveyance direction D upstream side than the inkjet heads 56C, 56M, 56Y, 56K. In such cases, the moisture in the paper P itself and the moisture in the process liquid are dried, instead of the moisture in the ink jetted onto the paper P being dried. In cases where the moisture in the process liquid is dried, the drying devices 90 may for example be reemployed in the process liquid drying units 50.

Explanation has been given of a case wherein the cross-sectional profiles of the duct 100 and the airflow path 100A are respectively rectangular shaped, however triangular, pentagonal and circular cross-sectional profiles are also possible. The shape of the duct 100 and the airflow path 100A as viewed from above may be configured as a V-shape along the first horizontal conveyance path 70A.

Explanation has been given of a case wherein plural of the fans 104A are provided along the length direction L of the airflow path 100A, however configuration may be made wherein a single fan 104A is provided extending in the length direction L of the airflow path 100A. In such cases, for example a cross-flow fan may be employed for the fan 104A.

In the above exemplary embodiment, an example has been given of a configuration employing CMYK standard colors (four colors), however combinations of the color of the inks and the number of colors are not limited to those of the exemplary embodiment, and pale or dark inks, or spot color inks may be added as required. For example, configuration may be made with added inkjet heads for jetting light inks such as light cyan or light magenta. There is no particular limitation to the disposal sequence of each of the inkjet heads.

In the above exemplary embodiment, the inkjet type inkjet recording apparatus 10 that employs ink is given as an example of an image forming apparatus. However the jetted liquid is not limited to inks for image recording or text printing, and various jetting fluids (droplets) may be applied provided that they are liquids employing a solvent or dispersion medium that permeates a recording medium.

Explanation has been given of a case in which the amount of ink jetted onto the recording face of the paper P is detected by the ink quantity detection sensor 97 and the airflow rate is controlled. However the airflow rate may be controlled by calculating the ink jetting amount based on dot data generated from image data.

Explanation has been given of a case where the hood 110 and the duct 100 are separate bodies, however the hood 110 may be formed integrally with the duct 100.

What is claimed is:

1. A drying device comprising:

an airflow path extending in a direction intersecting with a conveyance path of a recording medium along a longitudinal direction of the drying device;

an external air intake section that introduces external air into the airflow path; and a heating and blowing section provided to the airflow path that heats external air introduced into the airflow path and blows drying air onto a front face of the recording medium being conveyed on the conveyance path, wherein the heating and blowing section is configured to blow the drying air such that the rate at which drying air is blown onto the recording medium is uniform across the width direction of the recording medium, wherein a circulation opening is formed along the length direction of the airflow path, and wherein the circulation opening comprises a partitioning plate that partitions recirculated air that is drying air recirculated to the circulation opening and external air that has been introduced into the airflow path.

2. The drying device of claim 1, wherein:

the partitioning plate has two end portions;

the partitioning plate comprises a horizontal side extending horizontally towards the inside of the airflow path and a vertical side extending from a leading edge of the horizontal side towards the heating and blowing section; and both end portions of the partitioning plate are closed off with sealing plates.

3. The drying device of claim 1, wherein the circulation opening is formed to the conveyance path upstream side of the airflow path.

4. The drying device of claim 1, wherein: the heating and blowing section comprises a plurality of axial fans provided along the airflow path length direction that take in external air that has been introduced into the airflow path and recirculated air that has been recirculated to the circulation opening and blows out the combined air; and a heater that heats air blown from each of the axial fans to produce the drying air; and the circulation opening is formed with a size such that recirculated air is taken in uniformly by each of the axial fans.

5. The drying device of claim 1, wherein the external air intake section is provided at both sides of the airflow path.

6. The drying device of claim 1, wherein the heating and blowing section comprises a constricted opening that blows drying air onto the front face of the recording medium.

7. The drying device of claim 1, wherein a gripping member that grips the recording medium and conveys the recording medium on the conveyance path is attached to a moving member that travels in a circuit around the outside of the airflow path and the heating and blowing section.

8. An image forming apparatus comprising:

the drying device of claim 1; and a liquid droplet jetting head that is provided to the conveyance path upstream side of the drying device and that jets liquid droplets onto the recording medium and renders an image.

9. The image forming apparatus of claim 8, wherein: the external air intake section comprises a fan; and the image forming apparatus further comprises a controller that controls the airflow rate of the fan according to the liquid droplet amount jetted onto the recording medium.

10. The drying device of claim 1, wherein the heating and blowing section comprises:

a plurality of fans disposed in the longitudinal direction of the drying device, the plurality of fans blowing the drying air onto the recording medium.

11. The drying device of claim 10, wherein the circulation opening is formed with a size such that the respective plurality of fans takes in the recirculated air evenly.

12. The drying device of claim 1, further comprising:

an external air intake fan provided to a first side of the airflow path; and an external air discharge fan provided to the other side of the airflow path to discharge the external air introduced into the airflow path.

* * * * *